US005890041A

United States Patent [19]

Lewis

[11] Patent Number: 5,890,041

[45] Date of Patent: Mar. 30, 1999

[54] APPARATUS AND METHOD FOR NON-INTERACTIVE ELECTROPHOTOGRAPHIC DEVELOPMENT

[75] Inventor: Richard B. Lewis, Williamson, N.Y.

[73] Assignee: Xerox Corporation, Stamford, Conn.

[21] Appl. No.: 4,462

[22] Filed: Jan. 8, 1998

[51] Int. Cl.[6] ..... G03G 15/09

[52] U.S. Cl. ..... 399/276; 399/267; 399/277

[58] Field of Search ..... 399/276, 277, 399/267, 265, 275; 430/122; 347/158; 335/302, 301, 296

[56] References Cited

U.S. PATENT DOCUMENTS

| | | | |
|---|---|---|---|
| 4,292,387 | 9/1981 | Kanbe et al. | 430/102 |
| 4,557,992 | 12/1985 | Haneda et al. | 430/122 |
| 4,816,870 | 3/1989 | Nagayama | 399/267 |
| 4,868,600 | 9/1989 | Hays et al. | 399/266 |
| 4,936,249 | 6/1990 | Tajima et al. | 399/275 X |
| 5,247,317 | 9/1993 | Corver et al. | 347/158 |
| 5,409,791 | 4/1995 | Kaukeinen et al. | 430/54 |
| 5,532,804 | 7/1996 | Hirata et al. | 399/267 |
| 5,799,234 | 9/1998 | Furuya et al. | 399/277 |

*Primary Examiner*—Arthur T. Grimley
*Assistant Examiner*—Sophia S. Chen

[57] ABSTRACT

A development system for developing an image with developer material including a housing containing developer material; and a magnetic roll for transporting the developer material from the housing to the image, the magnetic roll including an magnetic core and a cylindrical sleeve enclosing and rotating about the magnetic core, the sleeve having a thickness between 0.001 to 0.006 inches.

6 Claims, 8 Drawing Sheets

APPARATUS AND METHOD FOR NON-INTERACTIVE ELECTROPHOTOGRAPHIC DEVELOPMENT

BACKGROUND OF THE PRESENT INVENTION

The invention relates generally to an electrophotographic printing machine and, more particularly, to the non-interactive development of electrostatic images.

The following application is incorporated herein by reference: patent application Ser. No. 09/004,456 entitled, "APPARATUS AND METHOD FOR NON-INTERACTIVE ELECTROPHOTOGRAPHIC DEVELOPMENT", which has been filed concurrently.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired image-wise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies. This invention relates to such image-on-image, non-interactive development.

Apparently useful non-interactive development methods known to the inventor work by generating a powder cloud in the gap between the photoreceptor and another member which serves as a development electrode. It is generally observed that this gap should be as small as possible, as small as 0.010 inches or smaller. Generally, the larger the gap, the larger become certain image defects in the development of fine lines and edges. The lines do not develop to the correct width, lines near solid areas are distorted, and the edges of solids are softened, especially at corners. It is believed that these defects are due to arches in the image electric fields over lines and at the edges of solid areas. In these arches electric field lines from image charges loop up and return to the photoreceptor ground plane instead of reaching across through the cloud to the development electrode. Defects result because toner in the cloud moves generally along field lines and cannot cross them into the arches, with the result that the deposited toner distribution does not correspond to image charge distribution. Defects due to field arches are less serious in interactive two component development because toner is carried into the arches by carrier particles. Nor do are they very serious in interactive single component development exemplified by U.S. Pat. No. 4,292,387 to Kanbe et al. because a strong, cross-gap AC field is superposed which overcomes the aforementioned field arch patterns.

In non-scavenging systems of the kind disclosed in the patents cited below, cross gap AC fields are also applied. However, it is important to realize that if such fields are made too strong, the system will become interactive due to toner impact on already developed images. Thus a system may image well at strong fields and develop non interactively at weak fields, but not do both simultaneously. The development electrode and its role in determining electric field structure is described, for example by H. E. J. Neugebauer in *Xerography and Related Processes*, Dessauer and Clark, Focal Press 1965. Powder cloud development is described, for example, in the paper "High Sensitivity Electrophotographic Development" by R. B. Lewis and H. M. Stark in *Current Problems in Electrophotography*, Berg and Hauffe, Walter de Gruyter, Berlin 1972.

U.S. Pat. No. 4,868,600 to Hays et al discloses a non-interactive development system wherein toner is first developed from a two-component developer onto a metal-cored donor roll and thereafter disturbed into a powder cloud in the narrow gap between the donor roll and an electrostatic image. Development fields created between the donor roll core and the electrostatic image harvest some of the toner from the cloud onto the electrostatic image, thus developing it without physically disturbing it. In this method the powder cloud generation is accomplished by thin, AC biased wires strung across the process direction and within the development gap. The wires ride on the toner layer and are biased relative to the donor roll core. The method is subject to wire breakage and to the creation of image defects due to wire motion, and these problems increase as the process width is increased. In this system it has been found important for image defect reduction to minimize the gap between the donor and the surface of the electrostatic image in order to create a close development electrode. Gap spacings of about 0.010 inches are characteristic. They would be smaller were it practical to maintain the necessary tolerances.

U.S. Pat. No. 4,557,992 to Haneda et al. describes a non-interactive magnetic brush development method wherein a two component employing magnetically soft carrier materials is carried into close proximity to an electrostatic image and caused to generate a powder cloud by the developer motion, sometimes aided by an AC voltage applied across the gap between the brush and the ground plane of the electrostatic image. Cloud generation directly from the surfaces of a two component developer avoids the problems created by wires. However, in practice such methods have been speed limited by their low toner cloud generation rate.

U.S. Pat. No. 5,409,791 to Kaukeinen et al. describes a non-interactive magnetic brush development method employing permanently magnetized carrier beads operating with a rotating multipole magnet within a conductive and nonmagnetic sleeve. Magnetic field lines form arches in the space above the sleeve surface and form chains of carrier beads. The developer chains are held in contact with the sleeve and out of direct contact with the photoreceptor by gradients provided by the multipole magnet. As the core rotates in one direction relative to the sleeve, the magnetic field lines beyond the sleeve surface rotate in the opposite sense, moving chains in a tumbling action which transports developer material along the sleeve surface. The strong mechanical agitation very effectively dislodges toner particles generating a rich powder cloud which can be developed to the adjacent photoreceptor surface under the influence of development fields between the sleeve and the electrostatic image. U.S. Pat. No. 5,409,791 assigned to Eastman Kodak Company is hereby incorporated by reference.

However, it has been observed that the use of bead chains according U.S. Pat. No. 5,409,791 requires that substantial clearance be provided in the development gap to avoid interactivity by direct physical contact between chains and photoreceptor. FIGS. 1 and 2, illustrates the rippled shape of the developer surface and the presence of bead chains. As a consequence of this clearance requirement the development electrode cannot be brought effectively close to the electrostatic image. With bead chains typical clearances are about 0.030 to 0.050 inches, whereas in a typical development system of the type described in U.S. Pat. No. 4,868,600 the gap between the donor and photoreceptor surface is brought down to about 0.010 inches. In devices according to U.S. Pat. No. 5,409,791 attempts to reduce the height of the developer mass by developer supply starvation have been found to result in a sparse brush structure of substantially the same height. Attempts to decrease the effective gap by increasing the electrical conductivity of the carrier have been partly successful. However, the open and stringy chain structure does not provide a very effective electrode material and problems remain, especially those related to image defects in lines and at edges.

SUMMARY OF THE INVENTION

The present invention obviates the problems noted above by providing a non-interactive development system substantially without chains of carrier beads in the development zone, without fragile wires, and utilizing a cloud source of mechanically agitated, permanently magnetized carrier. Thus this invention is both robust and permits a spacing between a development electrode and the electrostatic image of about 0.010 inch, a spacing small enough to eliminate or significantly reduce image defects associated with fine lines and edges. This is accomplished by reducing bead-bead magnetic interaction relative to the interaction between individual beads and the field gradients applied by the multipole magnet.

There is provided a development system for developing an image with developer material comprising: a housing containing developer material; and a magnetic roll for transporting said developer material from said housing to said image, said magnetic roll including an magnetic core and a cylindrical sleeve enclosing and rotating about said magnetic core, said sleeve having a thickness between 0.001 to 0.006 inches.

There is also provided an apparatus for non-interactive, dry powder development of electrostatic Images comprising an image bearing member bearing an electrostatic image; a housing containing developer material a magnetic roll for transporting said developer material from said housing to said image, said magnetic roll including an magnetic core and a cylindrical sleeve enclosing and rotating about said magnetic core, said sleeve having a thickness between 0.001 to 0.006 inches

DESCRIPTION OF THE INVENTION

Figure 1:
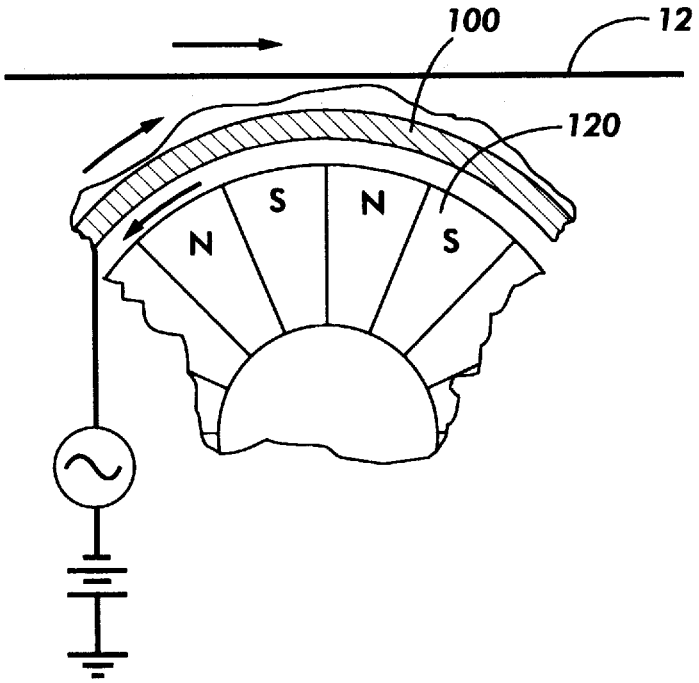
FIG. 1 PRIOR ART
FIG. 1 is a partial side view of a prior art development system.
Figure 2:
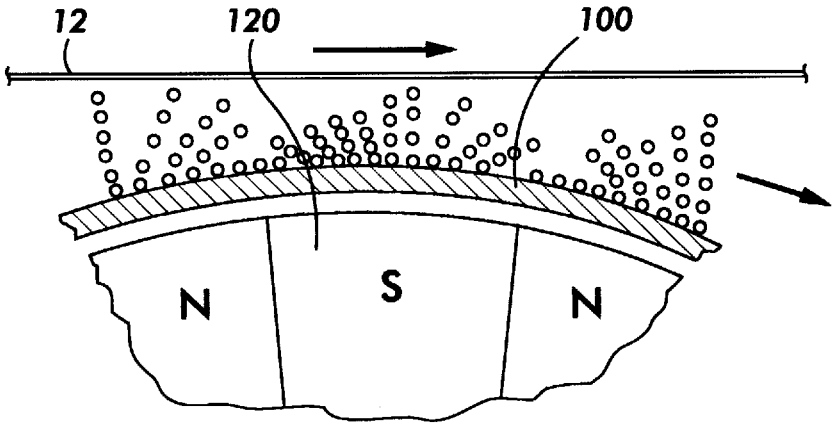
FIG. 2 PRIOR ART
FIG. 2 is a magnified view of part of the view of FIG. 1.
Figure 3:
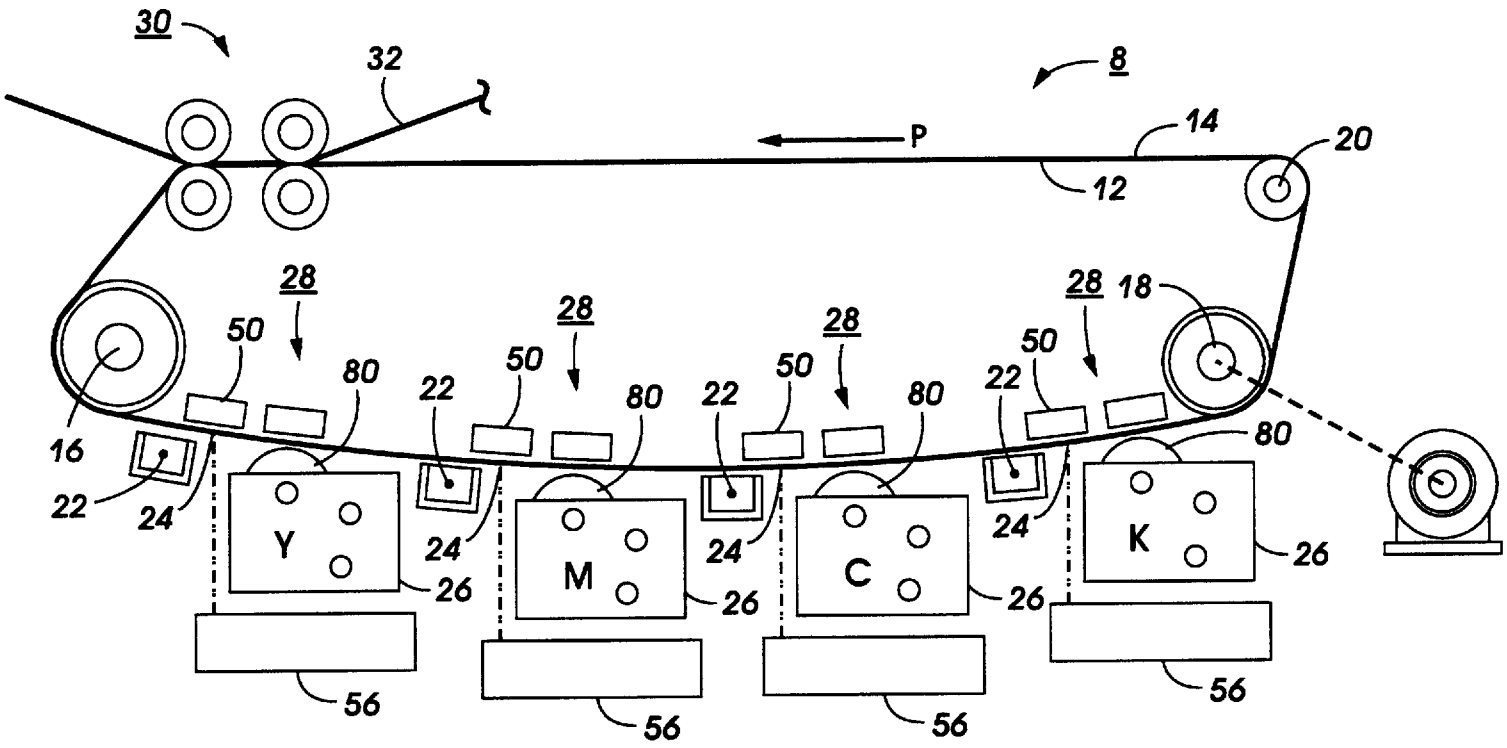
FIG. 3 is a side view, in section, of a four color xerographic reproduction machine incorporating the non-interactive developer of the present invention
Figure 4:
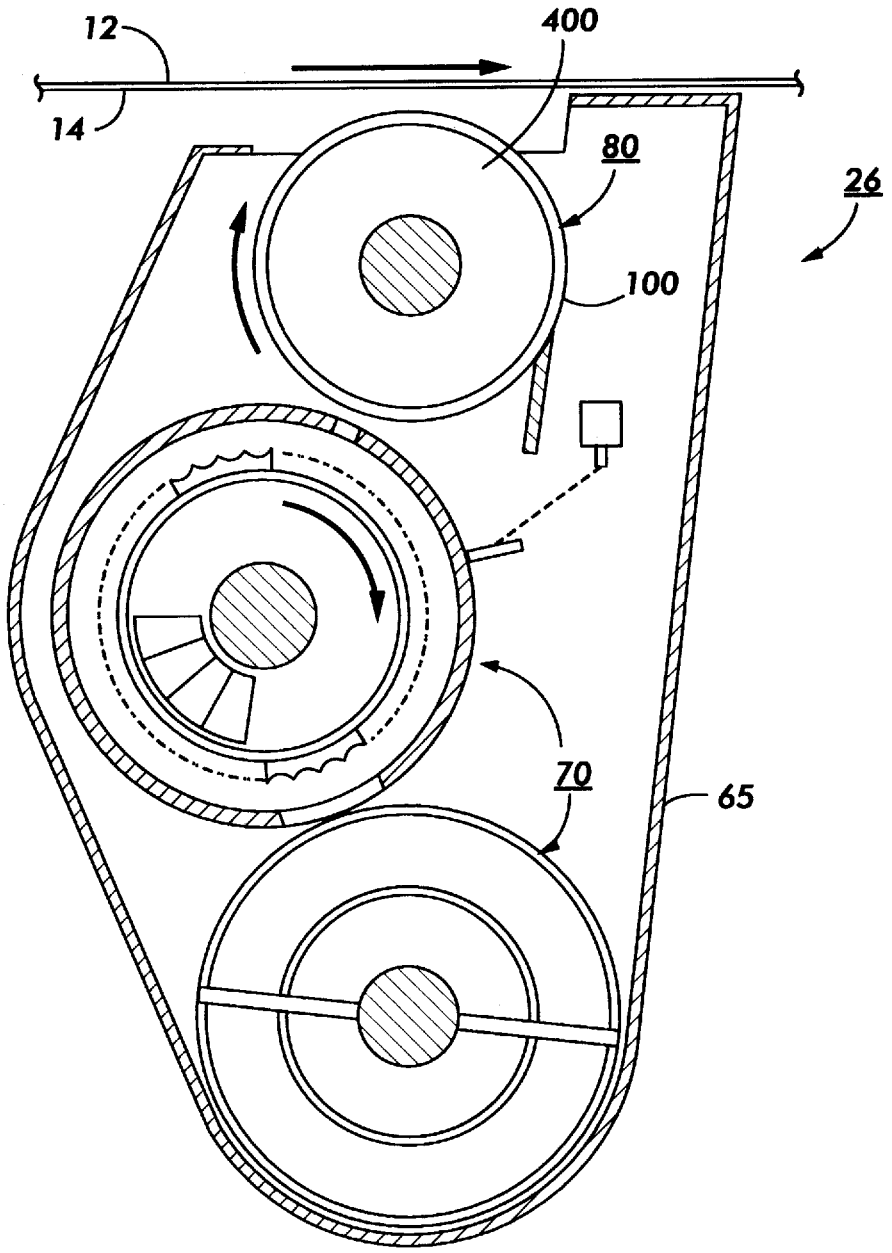
FIG. 4 is an enlarged side view of the developer assembly shown in FIG. 3 in a rotating tubular sleeve configuration.

Referring to FIG. 3 of the drawings, there is shown a xerographic type reproduction machine 8 incorporating an embodiment of the non-interactive development system of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16,18 and 20, and those of transfer assembly 30, the direction of movement being counterclockwise as viewed in FIG. 3 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station.

Developer assembly 26 includes a developer housing 65 in which a toner dispensing cartridge 66 (not shown) is rotatably mounted so as to dispense toner particles downward into a sump area occupied by the auger mixing and delivery assembly 70 as taught in U.S. Pat. No. 4,690,096 to Hacknauer et al which is hereby incorporated by reference.

Continuing with the description of operation at each developing station 24, a developing member 80 is disposed in predetermined operative relation to the photoconductive surface 14 of photoreceptor 12, the length of developing member being equal to or slightly greater than the width of photoconductive surface 14, with the functional axis of developing member 80 parallel to the photoconductive surface and oriented at a right angle with respect to the path of photoreceptor 12. Advancement of developing member 80 carries the developer blanket into the development zone in proximal relation with the photoconductive surface 14 of photoreceptor 12 to develop the electrostatic image therein.

A suitable controller is provided for operating the various components of machine 8 in predetermined relation with one another to produce full color images containing Y, M, C, K colored toner.

Figure 5:
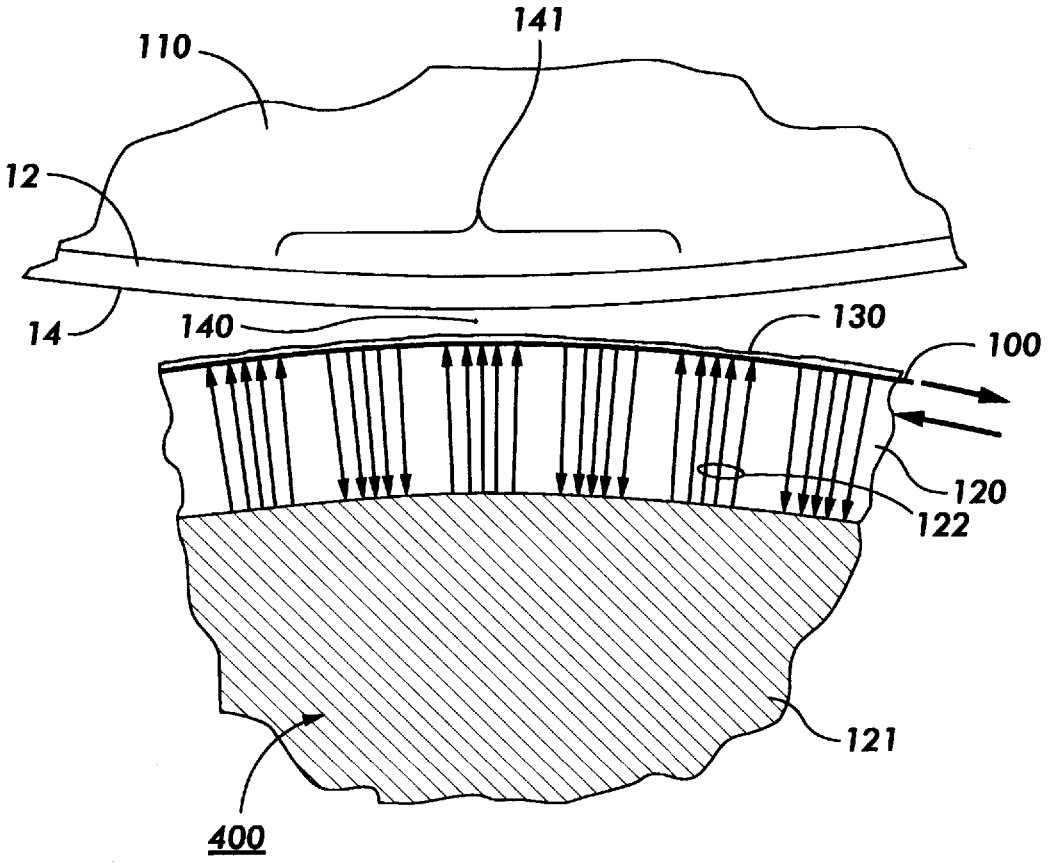
FIG. 5 is an enlarged view of the development zone of the developer assembly shown in FIG. 4.

Further details of the construction and operation of developing member 80 of the present invention are provided below referring to FIGS. 5–10. FIG. 5 shows, on an enlarge view of, photoreceptor 12, a rotatable sleeve 100, and magnet assembly 400. Gap 140 between the photoconductive surface 14 of photoreceptor 12 and the surface of the sleeve 100 is about 0.010 inches at its smallest and is maintained by a suitable mechanical arrangements including backing means 110, for example, a hardened, polished metal shoe. Development occurs in development zone 141. Magnet assembly 400 comprises an outer layer of permanent drive magnet 120 bonded to a cylindrical core 121 of iron or other soft magnet material. Magnet 120 contains regions of alternating magnetic polarization 122 arranged to create a multipole structure. Preferably the density of magnetization is a pure sinusoid with a period of about 2 mm, that is the magnet assembly has a pole spacing of about 1 mm. Sleeve 100 and magnet assembly 400 are made to rotate relative to one another about a common axis by suitable mechanical means. Preferably sleeve 100 is also rotated by these means relative to developer housing 26. It is known that the relative motion of sleeve 100 and magnet assembly 400 generate a rotating magnetic drive field (not shown) in a reference frame fixed to the surface of sleeve 100. A thin developer layer 130 is held on the surface of sleeve 100 and out of contact with photoconductive surface 14 by the gradient in the magnetic field generated in drive magnet 120. Developer layer 130 comprises about two monolayers worth of toner-bearing carrier beads 200 not visible on the scale of this figure.

Sleeve 100 can be fabricated using known methods such as electroforming non-magnetic metals on a cylindrical mandrel. Sleeve 100 is thin flexible, preferably the sleeve has a thickness between 0.001 to 0.008 inches. preferably the sleeve is composed of non-magnetic metal, such as selected from a group consisting of nickel-phosphorous, brass, and copper. Sleeve 100 closely conforms to magnetic assembly 400. Magnetic assembly 400 contains a composite containing at least 60% by volume neodymium-boron-iron hard magnet alloy In operation and has pole spacing between 0.5 and 2.0 millimeters. Sleeve 100 rides on the bearing surfaces as sleeve 100 rotates about magnetic assembly 400. The bearing surfaces allows relative rotation, and uniform support which supplies strength to the sleeve which prevent tendency for the sleeve to buckle under torque supplied from the end. It should be noted that lubricating films may be applied over the bearing surfaces to reduce friction.

Figure 6:
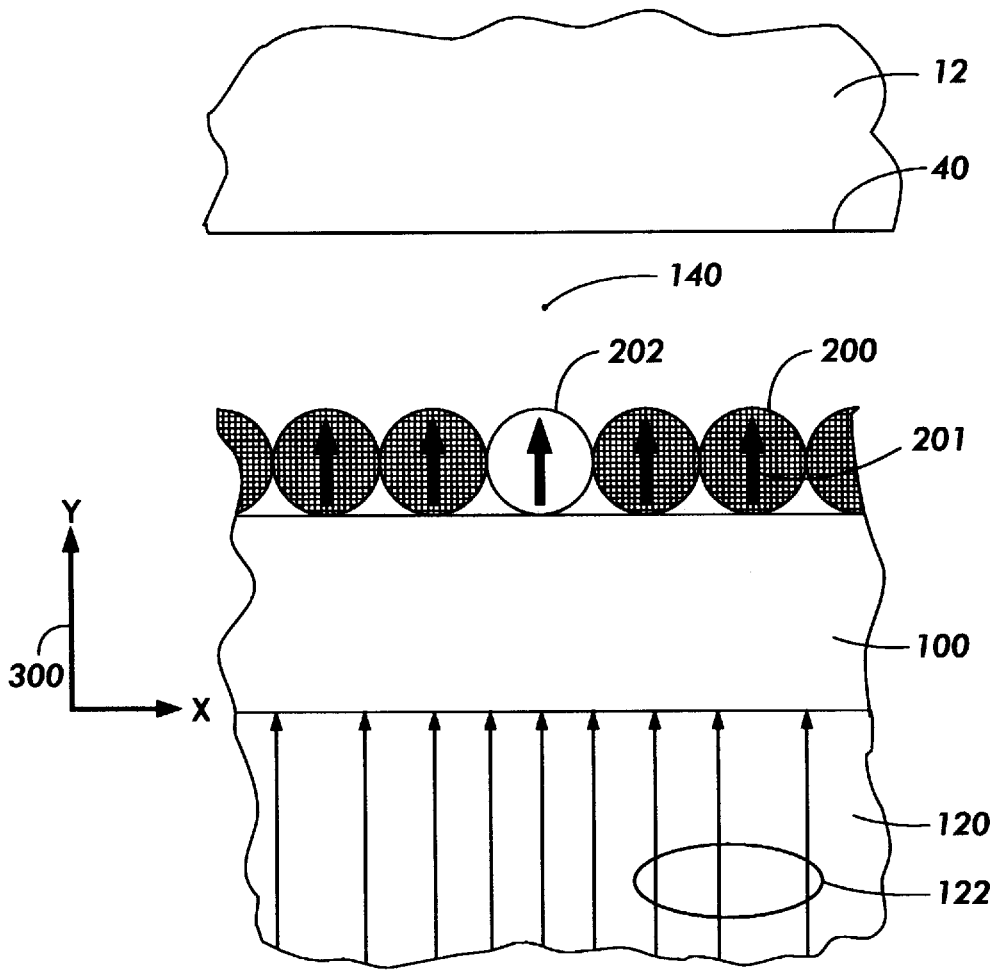
FIG. 6 is an enlarged cross section view of the view of FIG. 5 showing developer beads in a particular configuration corresponding to a magnetostatic potential energy $U_I$.

FIG. 6 shows in finer scale a portion of development zone 141. On this scale the relative curvature of sleeve 100 and drive magnet 120 is small, and it is an acceptable approximation to regard the region as flat. Layer 130 comprises permanently magnetized carrier beads 200, preferably of 50 to 100 microns in diameter, shown for purposes of illustration arranged in a close packed monolayer. Beads 200 are magnetized along the direction of the arrows 201, which represent the magnetic dipole moments of the beads. Beads 200 are oriented by the magnetic fields (not shown) due to a pole of the drive magnet 120 directly beneath. Equivalently, these fields arise from magnetic polarization 122, which has been drawn to a new scale relative to that of FIG. 5. Magnetic fields are nearly uniform and vertical so bead moments 201 are nearly parallel. A particular bead 202 is shown unshaded for purposes of illustration. In prior art methods bead configurations like that of FIG. 6 are energetically unstable. Let the magnetostatic energy of the configuration of FIG. 6 be designated $U_I$.

Figure 7:
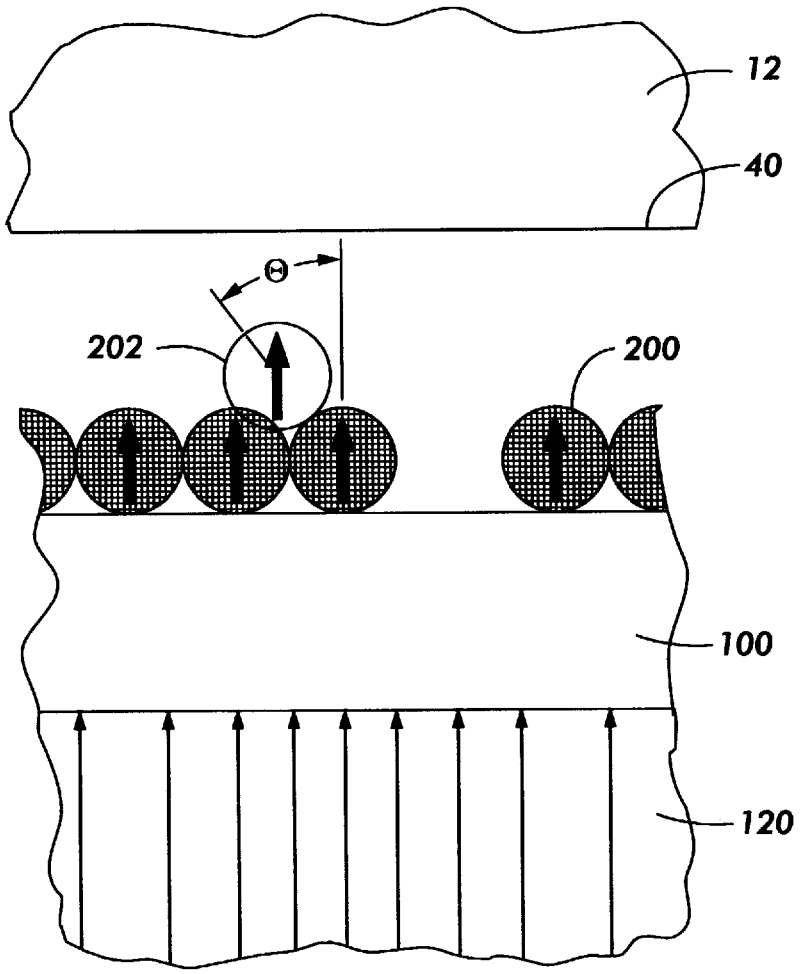
FIG. 7 is an, enlarged cross section view of the view of FIG. 5 showing developer beads in another configuration corresponding to a magnetostatic potential energy $U_{II}$.

In FIG. 7 the bead 202 is shown having moved to the pocket formed by three others to form what is evidently a shortest possible chain. Bead 202 has moved upward in the field gradient of the drive magnet 120 to a more head to tail relationship with the three supporting beads, thereby decreasing the magnetostatic energy of bead-bead interaction and increasing the magnetostatic energy of interaction between the bead magnetic moment and the gradient of the multipole magnet. In prior art devices the shortest chain of FIG. 7 can form spontaneously because the bead-bead interaction is the stronger. Let the magnetostatic energy of the configuration of FIG. 7 be designated $U_{II}$.

My invention operates without bead chains. It prevents the formation of even the shortest chain by making $U_{II}>U_I$. It does so by weakening the bead-bead interaction relative to the interaction between a bead and the gradient of the drive field. It will be evident that a condition preventing formation of the shortest chain also prevents the formation of any longer chain, because to form a longer chain requires even more energy, provided the beads considered stay in the strong gradients of the drive field. Quantitatively, my invention requires selecting magnetic design parameters in which $U_{II}>U_I$. To do so is a problem in magnetostatics that is solved approximately in the APPENDIX. The solution is expressed in terms of a parameter C given by:

$$C = 2.2\left(\frac{M_0}{M_b}\right)e^{-kt}ka,$$

where $M_o$ = drive magnet peak magnetization

-continued $M_b \equiv$ bead magnetization $k \equiv \frac{2\pi}{\lambda}$ $\lambda \equiv 2$(pole spacing), $t \equiv$ sleeve thickness, and $a \equiv$ bead radius;

and the condition $U_H > U_I$ will occur about when $C \geqq 1$.

It will be understood that the relationship $C \geqq 1$ is approximate because simplying assumptions were appropriate and because of distributions in bead sizes and shapes, non uniformity in bead magnetization, and other non-idealities in real devices. The examples will demonstrate the application of the condition. The examples will show that in prior art bead-chain methods the value of C has always been much less than 1, in one typical case $C \approx 1/70$. Further, they will show that, surprisingly, it is possible to reach $C \approx 1$ by deliberate means not before contemplated. Referring to the expression for C, it is clear that to raise its value, it is beneficial to increase $M_0$, the strength of the drive magnet 120, and to minimize the drive sleeve thickness t. Up to a point it is beneficial to raise k, the spatial frequency of magnetization in the drive magnet 120, which is equivalent to reducing pole spacing. However, if k is made too large, the exponential in kt will dominate, the fields of drive magnet 120 fields will not penetrate the developer sleeve, and beads cannot be retained. Up to a point, too, the value of bead magnetization $M_b$ may also be reduced. However, too great a reduction will obviously so much reduce $\mu$ that beads would not be retained.

Preferably the beads should exceed a bare monolayer in the development zone, in fact an equivalent of about two monolayers in developer layer 130 is preferred in order to increase the rate at which developable toner is carried into development zone 140. In this case the criterion for preventing chain formation is to be applied in the second layer of beads while regarding the first layer of beads to be an addition to the thickness t of sleeve 100. The following examples will more clearly illustrate the invention and the approximations made in its description.

Specific embodiments of the invention will now be described in detail. These examples are intended to be illustrative, and the invention is not limited to the materials, conditions, or process parameters set forth in these embodiments.

EXAMPLE 1

Figure 8:
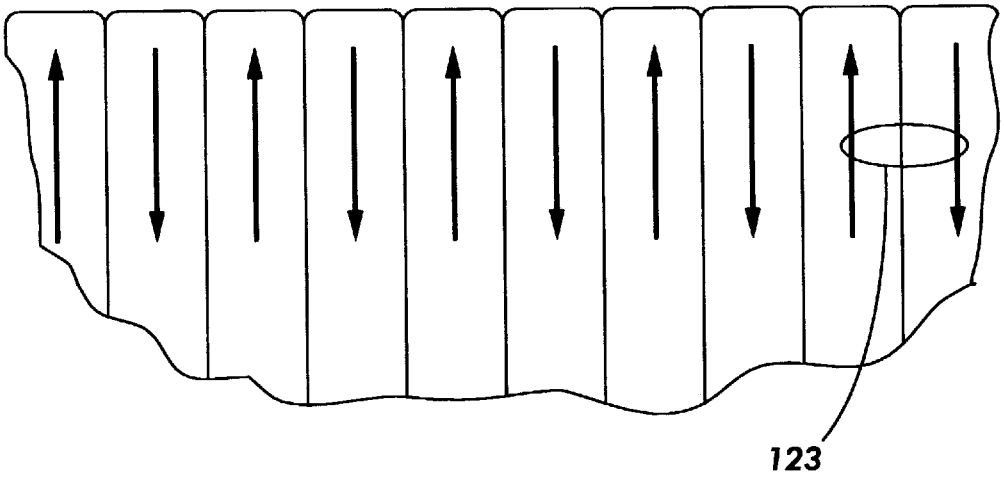
FIG. 8 is a schematic cross section of a flat multipole magnet structure having 1 mm pole spacing.
Figure 9:
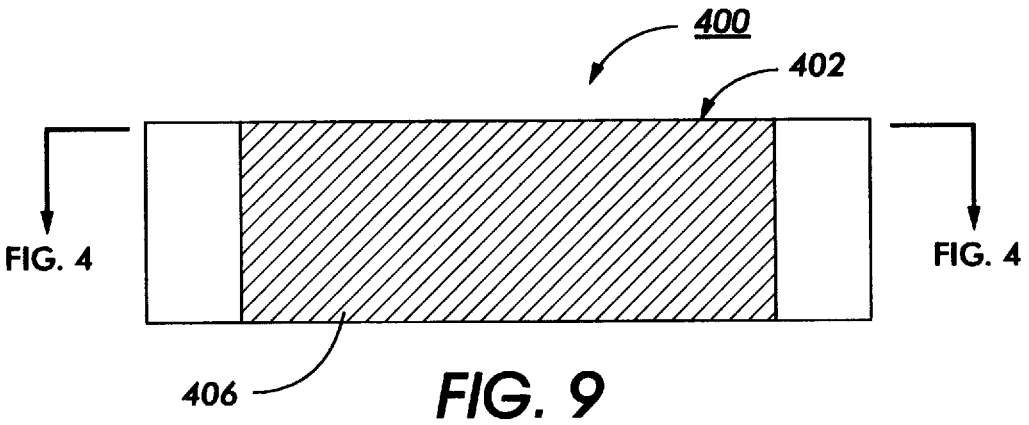
FIG. 9 is an enlarged view of the magnetic brush member of the developer assembly.
Figure 10:
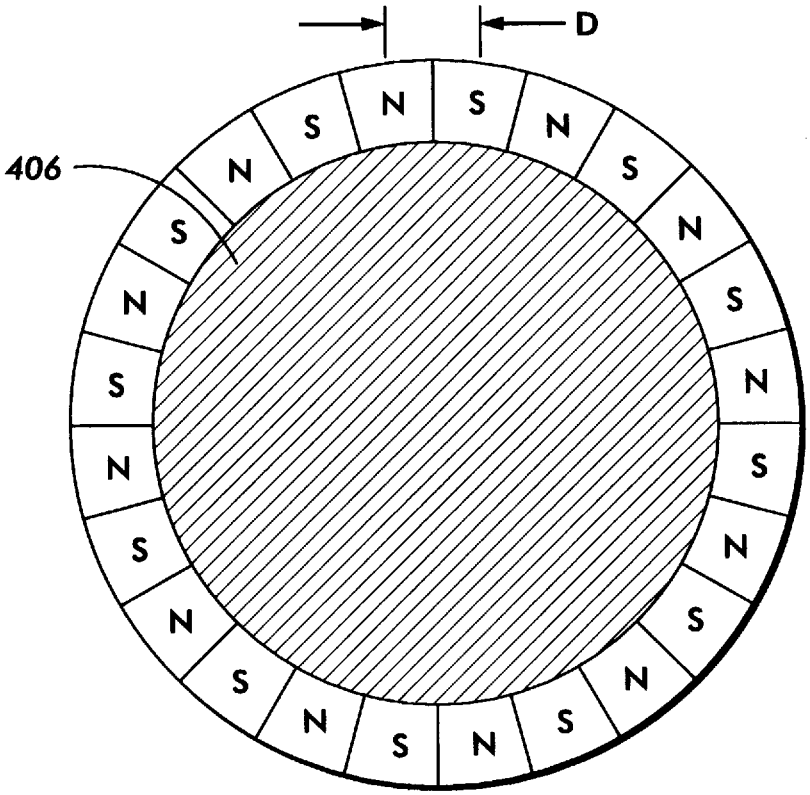
FIG. 10 is an enlarged cross section view of the magnetic brush member.

Referring to FIG. 8, one millimeter thick sheets of rubberbonded neodymium-boron-iron composite (type 1201 Arnold Engineering, Marengo, Ill.) were magnetized to saturation in-plane. Sheets were then stacked with alternating magnetizations 123 to form a magnetically stable, linear multipole structure having a pole spacing of 1 mm and magnetization $M_0$ of about 375 gauss. (From manufacturer's data $B_r$=4,700 gauss, thus, $M_0$=4700/4π=375 gauss.) The resulting magnetization was approximately twice that attainable with a ferrite material and had an approximately square profile instead of the preferred sinusoid. Otherwise the structure is a good flat version of the preferred drive magnet of my invention.

EXAMPLE 2

There were melt-blended together in an extruder, by weight,

| | |
|---|---|
| Styrene-n-butyl methacrylate polymer | about 50 parts |
| Conductex SC ultra carbon black | about 20 parts |
| Hoosier magnetics HM 181 hard ferrite powder | about 30 parts |

The cooled extrudate was broken up, air milled, and size classified to recover experimental quantities of carrier of nominal diameter 100 microns. This carrier was magnetized to saturation. The beads contain about 10% by volume of randomly oriented ferrite particles. Thus their saturated magnetization $M_b$ is about 20 gauss. ($M_{sat}$ for pure oriented strontium ferrite is about 380 gauss. The composite bead of example 1 is lower by 10× because of dilution and by 2× because of random particle orientation.) The saturation magnetization of these carrier beads is reduced relative to that of pure ferrite carrier, which is used conventionally in systems based on magnetically hard carrier.

EXAMPLE 3

Upon the magnetic structure of example 1 was placed a sheet of Mylar about 0.004 inches thick. On it was spread a thin layer of the carrier of example 2. Developer morphology was observed with a good binocular microscope. As the Mylar was drawn by hand across the poles of the magnet structure, simulating a moving sleeve 100, the carrier mass could easily be made to thin down to layers between one and three beads thick. Layers two beads thick were uniform in thickness with some magnet pole structure appearing as a slight thickness modulation. (It is believed that the observed thickness modulation was due to the non sinusoidal magnetization pattern of the magnet structure.) As the bead mass was moved across poles no chains were observed anywhere and beads were seen to rotate as individuals, each rubbing vigorously against its neighbors. The beads were densely packed rather than diffusely stringy as in a magnetic brush. Based on values estimated in examples 1 and 2 the value of C was computed to be about 5.

EXAMPLE 4

The procedure of example 3 was repeated substituting for the Mylar sheet a layer of cardstock about 0.016 inches thick covered with an approximate monolayer of carrier. Thus, relative to example 3, the value of t was increased fourfold and the bead mass was moved to a region of lower magnetic field and field gradient. As the cardstock was moved, some short, two or three bead chains were observed to form only over the pole faces. In this case the computed value of C was about 2. It is believed that this chain formation occurred because the non-ideal, rather square magnetization profile of the magnet assembly reduced field gradients over the pole faces.

EXAMPLE 5

The procedure of example 3 was repeated, substituting for the carrier material of example 2 a layer of pure strontium ferrite beads of 100 microns nominal diameter magnetized to saturation. The material had the consistency of wet sand. Relative to example 3 the value of $M_b$ was increased by about a factor of 10, so C was decreased to about ½. Beads were observed to slide on the Mylar, maintaining their places on the magnet structure. When a paper layer of the same thickness but of more tooth was substituted for the Mylar a monolayer of beads was observed to exhibit almost no chain formation. What chain formation did occur was seen over the pole faces. Flat strings of beads were also observed but these did not erect. In the usual sense there was almost no brush.

EXAMPLE 6

Example 1 of prior art U.S. Pat. No. 5,409,791 to Kaukeinen et al. had the parameters in the left column of the table below.

| | |
|---|---|
| Magnet to sleeve surface ≈ 1 mm (assumed) | t ≈ 1 mm |
| Roll diameter 50 mm & 12 poles | k = 0.25/mm |
| 850 gauss at sleeve surface | $M_0$ = 175 gauss |
| 55 emu/gm carrier beads | $M_b$ = 275 gauss |
| Carrier bead diameter 100$\mu$ (assumed) | a = 50 microns |

The values in the right column may, by known means, be derived from corresponding ones in the left column. The value of t includes clearance between the magnet and the sleeve typical in prior art devices. Roll magnetization $M_0$ was estimated by a formula in the APPENDIX. The value found is characteristic of rubber bonded ferrite magnets. Bead magnetization $M_b$ was found by dividing the left hand value by the density of ferrite. It is a bit larger than expected for isotropic strontium ferrite. Using the values of the right hand column, the computed value of C is seen to be about 1/73, and smaller carrier beads would make C even smaller. Thus, the prior art apparatus misses by almost two orders of magnitude the conditions called for in my invention.

EXAMPLE 7

The procedure of example 3 was repeated substituting for the magnet structure of example 1 a magnet from a commercial machine. It was 28.4 mm in diameter, of rubber bonded ferrite, and had 10 poles. Thus $M_0$ was about 175 gauss and k about 0.35/mm. Chains in excess of 10 beads were observed even with the diluted carrier of example 2. The computed value of C was about 1/3. (The magnetization profile appeared to be rather square, so smaller than expected gradients probably existed over the pole faces.) A marked reduction in bead magnetization was not by itself enough to prevent bead chains.

EXAMPLE 8

A developer was prepared with the carrier of example 2 and a conventional insulating toner comprised of a polyester resin, cyan pigment, and small surface amounts of silica and titania flow aides. The toner particle size was nominally 7 microns and it was present in the developer at about one half monolayer of toner coverage on developer beads. Shaken in a bottle the toner charged (negatively) against and clung to the carrier beads. A metallized Mylar foil was placed metal side up on the magnet structure of example 1 and on this was placed a dime-sized area of the above developer about two monolayers thick. Over this was placed a piece of ITO (indium tin oxide) coated glass, conductive side down, with 0.010 inch insulating spacers at its edges. The developer did not contact the ITO surface. A high voltage supply could be connected between the lower metallized layer and the upper ITO layer. The assembly thus simulated development zone 141 with the metallized Mylar simulating shell 100 and the ITO coated glass simulating photoreceptor 12.

In a first experiment the Mylar was translated manually in a direction across the poles of the magnet structure without applying voltage to the assembly. No toner deposition on the glass was observed.

In a second experiment 500 volts DC was applied to the sandwich without moving the Mylar. No toner deposition on the glass was observed.

In a third experiment 500 volts DC was applied to the sandwich and the Mylar was translated as before. Within about ¼ inch translation the glass became covered with toner. Toner had developed across the 0.010 inch gap. The assembly was then taken apart and the developer examined. Its color had changed to the black of the carrier and by microscope it had been stripped of much of its toner.

Thus, moving bead chains are not essential for effective cloud generation.

The independent rotational motion of beads in my invention is also effective.

APPENDIX

The purpose is to estimate the change in magnetostatic energy when a bead 202 is moved from a planar, close-packed shown in FIG. 6 to form a shortest chain shown in FIG. 7. The magnetostatic methods used here are known. See, for example, J. D. Jackson, Classical Electrodynamics, John Wiley and Sons, New York 1962. We make the following simplying assumptions: the geometry is flat as drawn in FIG. 7, only nearest-neighbor bead-bead interactions need be accounted for, beads may be regarded as uniformly magnetized spheres (and thus pure dipoles), and bead magnetic moments are always oriented along the lines of the drive field. The last assumption is reasonable because, unless bead moments are drastically reduced, there is a significant energy cost to rotate a moment away from a field line of drive magnet 120.

Bead-Bead Interactions are dipole-dipole interactions. The energy change due to bead-bead interactions is detailed below. The potential energy between a pair of dipoles is $$U = \frac{1}{r^3}\{\bar{\mu}_1 \cdot \bar{\mu}_2 - 3(\bar{\mu}_1 \cdot \hat{r})(\bar{\mu}_2 \cdot \hat{r})\}$$

where $r$ ≡ distance between bead centers $\hat{r}$ ≡ unit vector between bead centers $\bar{\mu}$ ≡ bead magnetic dipole moment Because beads align with the drive field their dipoles are locally parallel to each other, and the expression above simplifies to $$U = \frac{\mu_2}{r^3}(1 - 3\cos^3\theta)$$

where angle θ is that between the line between bead centers and moment direction as shown FIG. 7

Referring to FIG. 6, in state I bead 202 is surrounded by six equivalent nearest neighbors, and the distance between bead centers is 2a, where a is the bead radius. Thus the bead-bead part of the energy of state I, $$U_{BI} = 6\frac{1}{(2a)^3}(\mu^2 - 3 \cdot 0 \cdot 0) = \frac{3\mu^2}{4a^3}$$

Referring to FIG. 7, in state II the bead 202 is tucked above and against three equivalent nearest neighbors. Thus $$U_{BII} = 3\frac{\mu^2}{(2a)^2}(1 - 3\cos^2\theta) = -\frac{3}{8}\frac{\mu^2}{a^3} \quad \text{because } \cos^2\theta = \frac{2}{3}$$

Combining these results yields the dipole-dipole part of ΔU:

$$U_{BII} - U_{BI} = \left(-\frac{3}{8}\frac{\mu^2}{a^3}\right) - \frac{3}{4}\frac{\mu^2}{a^3} = -\frac{9}{8}\frac{\mu^2}{a^3}$$

$$= -\frac{3\pi}{2}\mu M_b$$

The last step uses the well known equivalence (magnetization x volume) for the dipole moment of a uniformly magnetized sphere. This term is negative. It is what dominates to form bead chains in prior art magnetic brush systems Computing the fields and field gradients of drive magnet 120: FIG. 6 shows drive magnet 120 and particularly coordinate axes 300 which are used in the following. The magnet material is assumed to be magnetized normal to its pole-bearing interface as follows $$\overline{M} = \hat{y}\, M_0 \cos(kX)$$

$$k \equiv \frac{2\pi}{\lambda}$$

$$\lambda \equiv 2(\text{pole spacing})$$

Finding the resulting magnetic field is a standard problem in potential theory. There is no pole density except at the interface; so, everywhere except there, the H field is derivable from some potential $\phi$ such that $$\nabla^2\phi = 0$$

$$H_x = -\frac{\partial\phi}{\partial x}$$

$$H_y = -\frac{\partial\phi}{\partial y}$$

The boundary conditions are first that solutions be well behaved at infinity and second that at the magnet interface both $\phi$ and the normal component of B are continuous. It will be found by substitution that the following is a solution:

$$\phi = \frac{2\pi M}{k} e^{-ky}\cos(kx) \quad y \geqq 0$$

$$\phi = \frac{2\pi M}{k} e^{+ky}\cos(kx) \quad y \leqq 0$$

thus, $$H_x = -\frac{\partial\phi}{\partial x} = 2\pi M_0 e^{-ky}\sin(kx)$$

$$H_y = -\frac{\partial\phi}{\partial y} = 2\pi M_0 e^{-ky}\cos(kx) \quad y \geqq 0$$

The problem is linear, so this solution can be shown to be unique. Conditions at the interface are satisfied.

Of course the higher harmonics of an arbitrary, periodic roll magnetization profile could be used to construct a Fourier solution, but the important term is the fundamental because it reaches farthest above the drive roll. The preferred form of magnetization is sinusoidal.

The energy change due to the bead-drive field interaction: From the H field solution above and because $$|H| = \sqrt{H_x^2 + H_y^2}$$

$$|H| = 2\pi M_0 e^{-ky}$$

The potential energy of a magnetic dipole of strength $\mu$ aligned with this field is $$U = -\mu|H| = -2\pi\mu M_0 e^{-ky} \quad y \equiv \text{distance from center of bead 202 to surface of magnet 120.}$$

The energy change between state II and state I is just that due to the change in position of bead 202 according to the expression immediately above. The upward displacement of bead 202 is not quite 2a and can be worked out with a little geometry and FIG. 7.

$$U_{DII} - U_{DI} = -2\pi\mu M_0 e^{-k(t+2.63a)} + 2\pi\mu M_0 e^{-k(t+a)} = 2\pi\mu M_0 e^{-k(t+a)}(e^{-1.63ka} - 1) \approx 2\pi\mu M_0 e^{-kt}(1 - 1.63ka + -1)$$

Thus the final energy change due to the bead-drive field interaction is $$U_{DII} - U_{DI} \approx 2\pi\mu M_0 e^{-kt}(1.63ka)$$

This is positive. It takes work to lift bead 202 against the gradient.

Adding the energy changes due to both bead-bead and bead-drive field interactions yields the result $$U_{II} - U_I = -\frac{3\pi}{2}\mu M_b + 3.26\pi\mu M_0 e^{-kt}ka = \mu\left\{-\frac{3\pi}{2}M_b + 3.26\pi M_0 e^{-kt}ka\right\}$$

Provided $\mu$ is not zero, $U_{II} > U_I$ whenever the term is curly brackets is positive, that is when the parameter C, defined below, is greater than one:

$$C \equiv \frac{3.26\pi M_0 e^{-kt}ka}{\frac{3\pi}{2}M_b} \geqq 1$$

thus $$C = 2.2\left(\frac{M_0}{M_b}\right)e^{-kt}ka \geqq 1$$

This is the criterion for bead chain suppression.

Thus it is possible to make developer layers of permanently magnetized carriers which are substantially without bead chains, in which the beads are densely packed into a fluid like state, and in which they rotate as individuals. Advantages include a more closely spaced development electrode and a denser developer mass. It will be appreciated that both the examples and the computation for the parameter C were necessarily approximate. Magnet profiles were squarish rather than sinusoidal, while C was computed for the preferred sinusoidal magnetization pattern.

Beads were disperse in size and shape. And because they were bulk magnetized, beads were probably not uniformly magnetized. Thus the value of C to be regarded as characterizing my invention has a spread which should be judged against the very distant prior art value of about 1/100, which characterizes a qualitatively different apparatus. It will also be appreciated that the particular form of drive magnet magnetization was chosen for ease and clarity of illustration, and that any form resulting in substantially the same exterior magnetic fields would do as well and is encompassed in my invention.

The invention has been described in detail with particular reference to a preferred embodiment thereof, but it will be understood that variations and modifications can be effected within the spirit and scope of the invention as described hereinabove and as defined in the appended claims.

I claim:

1. In a development system for developing an image with developer material comprising:

a housing containing developer material;

a magnetic roll for transporting said developer material from said housing to said image, said magnetic roll including an magnetic core and a cylindrical sleeve enclosing and rotating about said magnetic core, said sleeve having a thickness between 0.001 to 0.006 inches; and a cylindrical bearing surface, in contact with a substantially portion of an inner surface of said sleeve, for providing relative rotation, and uniform support which supplies strength to said sleeve.

2. The development systems according to claim 1, wherein said a cylindrical bearing surface is said magnetic core.

3. The development system according to claim 1, wherein said magnetic core comprises a multipole magnet member.

4. The development system according to claim 3, wherein said multipole magnet member is comprised of a composite containing at least 60% by volume neodymium-boron-iron hard magnet alloy.

5. The development system according to claim 3, wherein said multipole magnet member has pole spacing between 0.5 and 2.0 millimeters.

6. In a development system for developing an image with developer material comprising:

a housing containing developer material;

a magnetic roll for transporting said developer material from said housing to said image, said magnetic roll including an magnetic core and a cylindrical sleeve enclosing and rotating about said magnetic core, said sleeve having a thickness between 0.001 to 0.006 inches, said sleeve is made by electroforming metals selected from a group consisting of nickel-phosphorous, brass, and copper.

* * * * *